US006167914B1

(12) United States Patent
Koteskey

(10) Patent No.: US 6,167,914 B1
(45) Date of Patent: Jan. 2, 2001

(54) ORIFICE PROTECTOR

(76) Inventor: Gary L. Koteskey, 06598 Horton Bay North Rd., Boyne City, MI (US) 49712

( * ) Notice: Under 35 U.S.C. 154(b), the term of this patent shall be extended for 0 days.

(21) Appl. No.: 09/520,701

(22) Filed: Mar. 7, 2000

Related U.S. Application Data

(63) Continuation of application No. 29/099,618, filed on Jan. 25, 1999.

(51) Int. Cl.[7] ..... F16L 57/00; E02B 13/00

(52) U.S. Cl. ..... 138/110; 138/113; 138/151; 138/156; 138/177; 138/DIG. 11; 405/48

(58) Field of Search ..... 138/110, 112, 138/113, 151, 156, 177, 178, DIG. 11; 405/45, 47, 48

(56) References Cited

U.S. PATENT DOCUMENTS

| | | | | |
|---|---|---|---|---|
| 953,080 | * | 3/1910 | Wiggins . | |
| 1,165,137 | * | 12/1915 | Smith | 138/178 |
| 1,608,889 | * | 11/1926 | Lampe . | |
| 2,637,170 | * | 5/1953 | Benedict . | |
| 3,583,424 | * | 6/1971 | Bryant | 138/156 |
| 3,741,252 | * | 6/1973 | Williams | 138/110 |
| 4,543,998 | * | 10/1985 | Thomerson | 138/110 |
| 4,904,112 | * | 2/1990 | McDonald | 405/45 |
| 4,950,103 | * | 8/1990 | Justice | 405/43 |
| 5,300,732 | * | 4/1994 | Wambeke et al. | 138/156 |
| 5,560,397 | * | 10/1996 | Miller et al. | 138/110 |
| 5,785,454 | * | 7/1998 | Ringdal et al. | 405/45 |

* cited by examiner

*Primary Examiner*—James Hook
(74) *Attorney, Agent, or Firm*—Locke Reynolds LLP

(57) ABSTRACT

An orifice protector for use in subterranean fluid dispensing systems defined by at least one conduit for disposing of wastewater. The orifice protector includes a body in the form of partial cylinder having two ends. The partial cylinder is formed a wall of substantially constant thickness having a C-shaped cross section having an outer and an inner surface. A central portion of the wall includes a plurality of openings such as slits extending between the outer and inner surfaces to allow the outward flow of wastewater from orifices existing in the conduit. The slits are situated about parallel to the ends and extending through about a 90° arc length. The wall also has two longitudinal, linear, parallel edges of equal length separated by a slot adapted to receive the conduit. The wall is composed of a material such as abs or pvc so that the two longitudinal edges are deflectable away from each other and biased toward each other to grip an outer surface of the conduit to stabilize the location of the protector relative to the conduit. The body includes stand-off portions integral with the two ends of the wall and consisting essentially of downwardly and inwardly indented portions of the two ends of the wall for maintaining the central portion of the wall spaced from the conduit while preventing the inward migration of the material such as soil, rocks, stones, pebbles or gravel in which the system is buried.

14 Claims, 3 Drawing Sheets

ORIFICE PROTECTOR

CROSS-REFERENCE TO RELATED APPLICATION

This is a continuation of co-pending application Ser. No. 29/099,618 filed Jan. 25, 1999.

BACKGROUND OF THE INVENTION

The present invention is directed generally to apparatus for use in subterranean fluid dispensing systems for disposal of wastewater. The invention is particularly directed to apparatus for inhibiting material such as rocks, stones, pebbles and gravel from clogging an outlet orifice of a pressurized subterranean wastewater dispensing system.

Subterranean wastewater dispensing systems typically do not dispense wastewater into the surrounding material on a continuous basis. Instead, the dispensing systems are typically called upon only periodically to dispense such wastewater. During the time when wastewater is not being dispense, the material surrounding the dispensing system experiences a hydraulic relaxation during which time particulate materials may migrate toward openings or orifices used in the system to dispense the wastewater and may plug or at least inhibit the flow through such openings or orifices.

This problem has been recognized previously and a number of solutions have been proposed.

Some wastewater dispensing systems have been constructed from short segments of tubing or pipe or drain tile. Adjacent ends of the short segments are separated by coupling sleeves or supports which allow for the wastewater to drain into the material below the short segments. Systems of this type are suitable for use only in very low pressure situations such as gravity fed outlets from septic tanks and are not suitable for use in pressurized systems. Examples of such systems are to be found in Steen, U.S. Pat. No. 1,518,014; Benedict, U.S. Pat. No. 2,637,170; and Zaucha, U.S. Pat. No. 3,225,546.

The preferred wastewater dispensing systems are constructed from substantially continuous pipes or tubes having a plurality of openings or orifices dispersed at spaced intervals along the length of the pipes or tubes. While such systems can be used in low pressure situations, they are also suitable for use in pressurized wastewater dispensing situations. Sleeves or casings have been employed to protect the openings or orifices from being clogged by the surrounding material. The sleeves often have to be slipped or threaded onto the end of the pipe or tube, and then moved along until aligned with the orifice to be protected. An example is shown in Chisholm, U.S. Pat. No. 299,347. The assembly process for such an arrangement is very time-consuming, and therefore undesirable.

To avoid the threading operation, some orifice protectors have been designed to merely sit on to of the pipe or tube over the orifice to be protected. Examples are shown in Wiggins, U.S. Pat. No. 953,080 and Ball, et al., U.S. Pat. No. 5,360,556. However, such orifice protectors are easily disturbed from their desired location during the back-filling operation, and are nearly impossible to use in circumstances where the orifices of the pipe or tube are located on the bottom or side of the pipe or tube.

A more suitable protector for such orifices is shown in Ringdal, et al., U.S. Pat. No. 5,785,454 which can be placed at any location along the length of a pipe or tube, and protects a dispensing opening in the tube or pipe regardless of its orientation. The structure requires the use of pins to secure the protector in position relative to the pipe which leads to a time-consuming assembly of the system as a whole.

What was missing from the prior art was an orifice protector that could be easily added at any point along the dispensing pipe or tube without the need to thread the protector on from an end of the pipe or tube, would remain fixed relative to the pipe or tube once placed in the desired relation relative to an orifice in the dispensing tube or pipe, and consisted essentially of a single element which required no pre-assembly.

SUMMARY OF THE INVENTION

An orifice protector of the present invention is intended for use in subterranean fluid dispensing systems that include at least one conduit for disposing of wastewater, the conduit having a plurality of orifices distributed at spaced intervals along the length of the conduit(s). An orifice protector of the present invention is employed to protect one such orifice. A fluid dispensing system would generally employ a plurality of the protectors of the present invention with one orifice protector being employed to protect each orifice along the length of the conduit(s) forming the system.

Each orifice protector would generally comprise a body in the form of a partial cylinder or collar defined by a wall having a C-shaped cross section, the wall having an outer and an inner surface. A central portion of the wall includes a plurality of openings extending between the outer and inner surfaces. The wall also has two longitudinal edges separated by a slot adapted to receive said conduit, the two longitudinal edges being deflectable away from each other and biased toward each other to grip said conduit. The wall also has two ends including stand-off portions for maintaining the central portion of the wall spaced from said conduit.

The stand off portions ensure that the openings in the central portion of the wall of the orifice protector are spaced from the orifice being protected thus providing a region into which wastewater from the conduit can flow without immediately facing the material such as soil, rocks, stones, pebbles or gravel in which the system is buried. Each of the plurality of openings in the central portion of the wall preferably has a sufficient cross-section to inhibit the migration of the adjacent material toward the adjacent orifice being protected by the protector. The plurality of openings in the central portion of the wall taken together preferably have a cross-sectional area many times that of the adjacent orifice thereby providing ample area for outflow of wastewater. The size of the slot and the length of the stand-off portions are chosen to provide sufficient gripping force between the orifice protector and the conduit to maintain the orifice protector in fixed location, even during system installation procedures such as back fill operations, and the like. The slot allows the orifice protector to be added at any point along a nearly continuous length of conduit, rather than having to be threaded or slipped onto an end of a section of a conduit, and to be applied to conduits having a range of diameters.

The plurality of openings in an orifice protector of the present invention can take a number of shapes, however a plurality of slits situated generally parallel to the ends of the protector has proven to be a particularly advantageous arrangement. Preferably each of the slits extends through about a 90° arc length of the wall forming the orifice protector. The stand-off portions preferably are integral with the wall portion of the orifice protector, and are preferably formed by downwardly and inwardly indented portions of the two ends of the wall forming the orifice protector.

The wall forming the orifice protector can be of any suitable thickness but is most easily formed to have a substantially constant thickness separating the outer and inner surfaces. A readily available material for forming the orifice protector of the present invention is schedule 40 plastic tubing conventionally employed in wastewater systems which is then cut into suitable lengths and cut again to form the two longitudinal edges are preferably linear and substantially parallel to each other. The ends are then plastically deformed to the desired shape to form the stand-off portions. Of course the same or a functionally equivalent shape can be obtained by injection molding or other suitable processes.

The orifice protector of the present invention is formed of a single element that can be easily added at any point along a dispensing conduit having a range of diameters and, once added, remains fixed at the desired location relative to the conduit and to an orifice in the conduit. The orifice protector can be used in any orientation and resists displacement during back-fill. These and other features will become apparent upon consideration of the accompanying drawings illustrating the preferred embodiment of the present invention.

DESCRIPTION OF THE PREFERRED EMBODIMENTS

Figure 1:
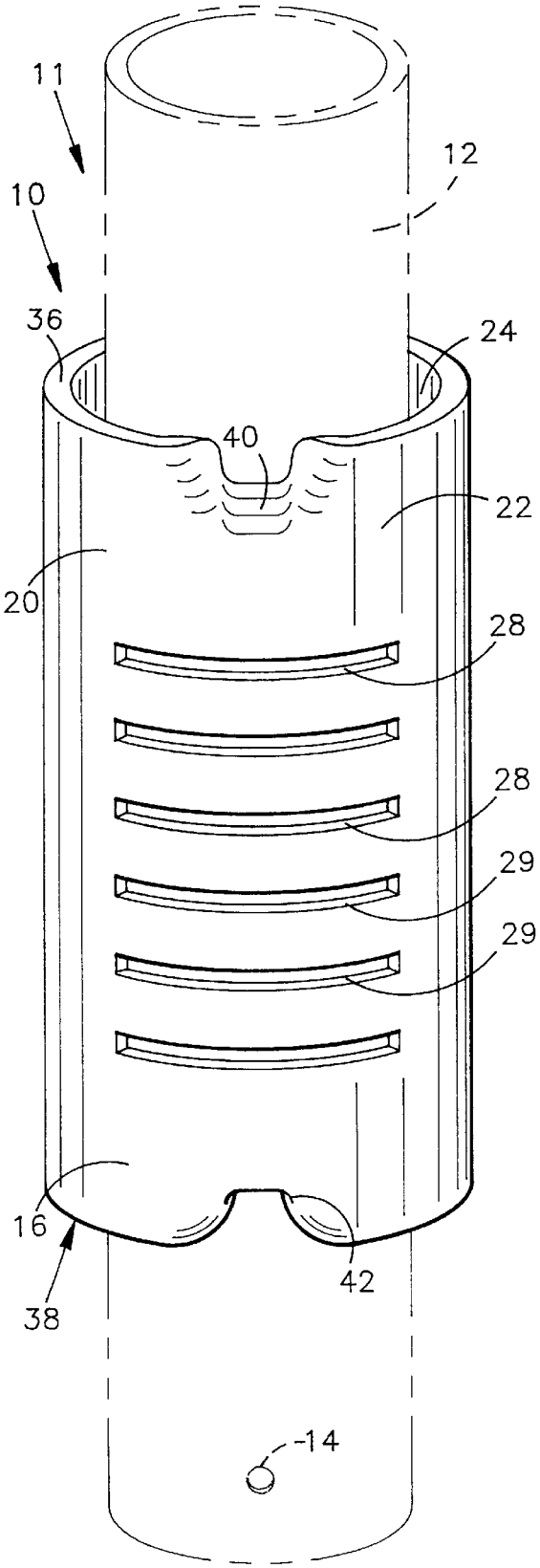
FIG. 1 is a perspective view of an orifice protector of the present invention connected to a segment of conduit shown in phantom.
Figure 2:
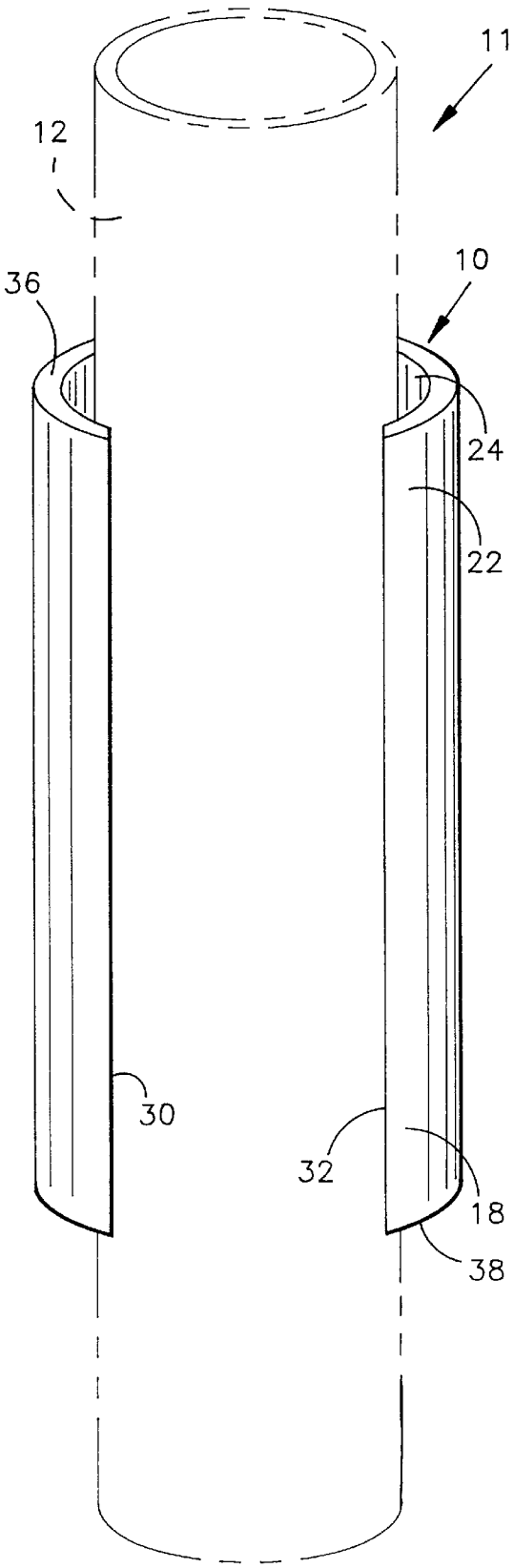
FIG. 2 is another perspective view from the opposite side of the orifice protector shown in FIG. 1.
Figure 3:
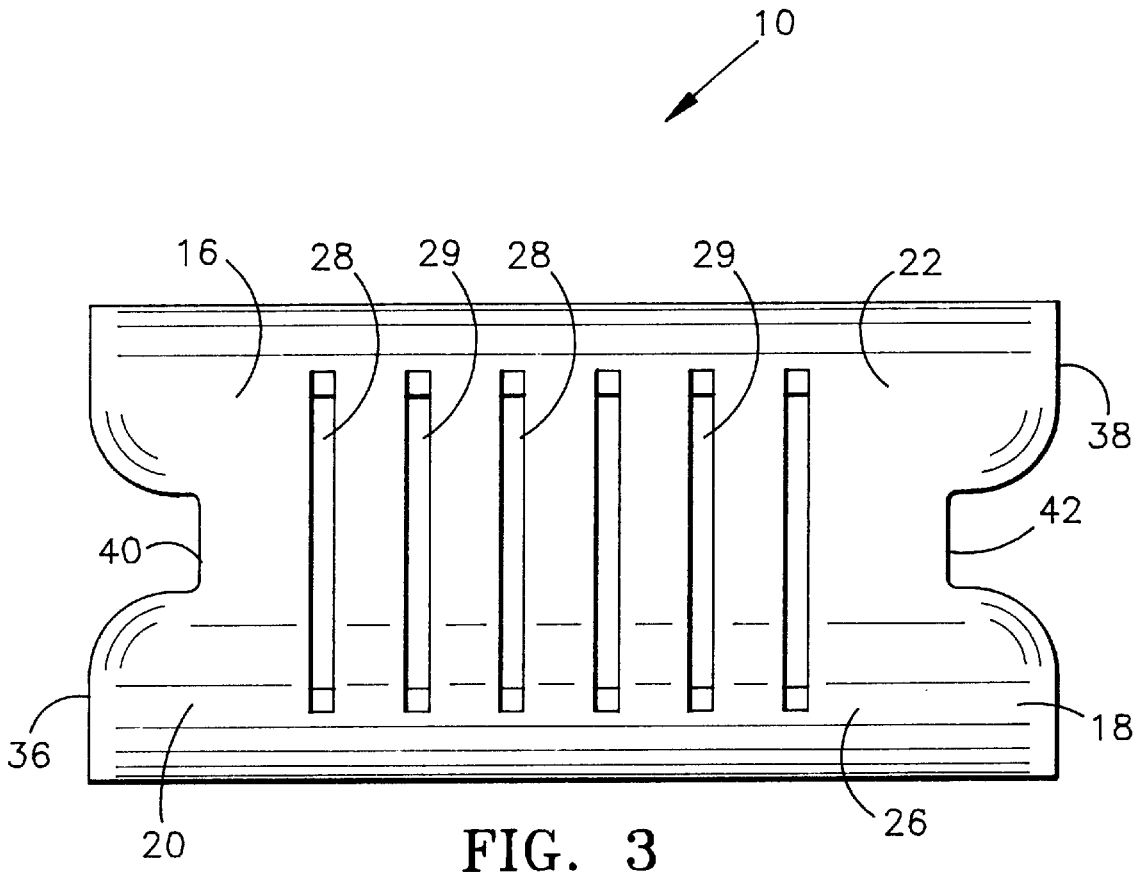
FIG. 3 is a plan view of the orifice protector shown in FIG. 1.
Figure 4:
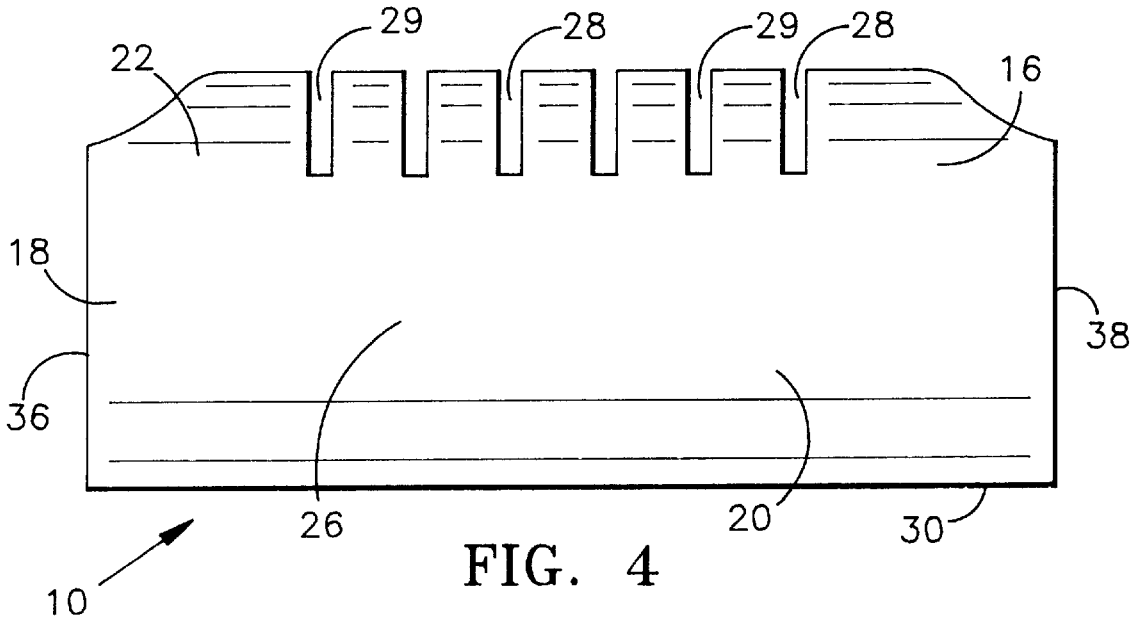
FIG. 4 is a side elevation of the orifice protector shown in FIG. 1.
Figure 5:
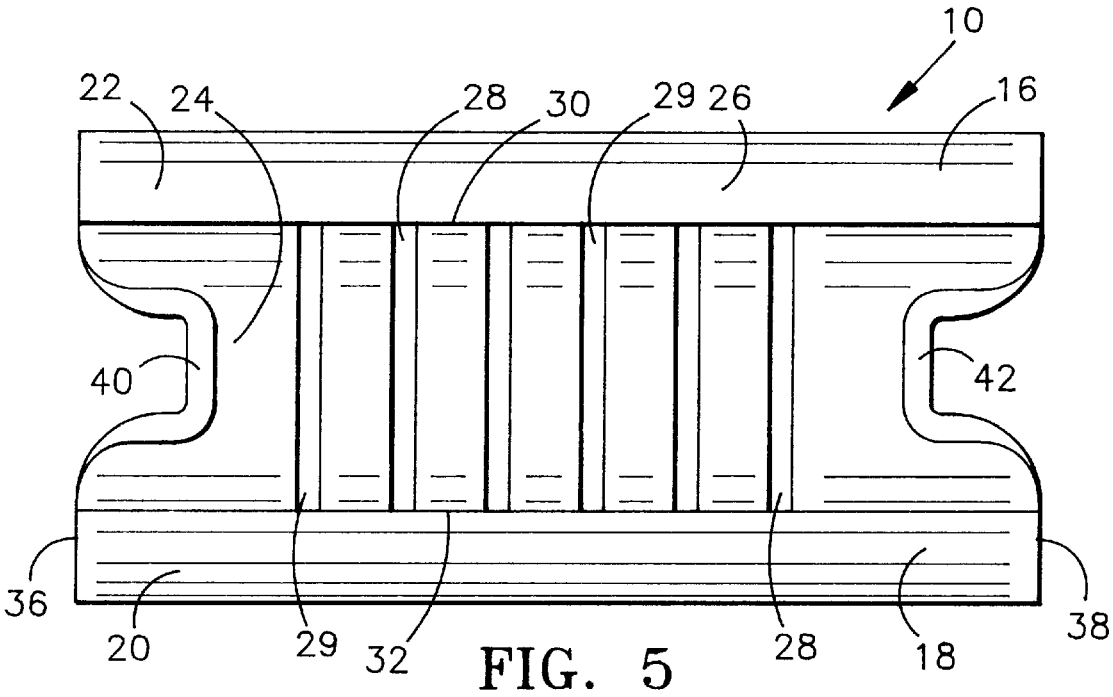
FIG. 5 is a plan view of the orifice protector from a side opposite that shown in FIG. 3.

An orifice protector 10 of the present invention is shown in FIGS. 1 and 2 installed as it might be used, for example, in a subterranean fluid dispensing system 11 that would include at least one conduit 12, shown in phantom, for disposing of wastewater. The conduit 12 generally has a plurality of orifices 14 distributed at spaced intervals along the length of the conduit 12. Each orifice 14 is preferably sufficiently large that any particulate matter carried by the wastewater wall pass though the orifice 14 without any difficulty, yet sufficiently small that any gravel or other particulate matter in which the conduit is situated will not be ingested into the conduit 12. The orifice protector 10 is generally employed to cover and thereby protect one such orifice 14, although conduits could have the orifices clustered into groups so closely spaced that only a single orifice protector 10 could be used with more than one orifice 14. A fluid dispensing system 11 would generally employ a plurality of the protectors 10 with one orifice protector 10 being employed to protect each orifice 14 along the length of each of the conduits 12 forming the system 11. The orifice protector 10 is formed of a single element that can be easily added at any point along a dispensing conduit 12 and, once added, remains fixed at the desired location relative to the conduit 12 and to an orifice 14 in the conduit 12.

Figure 6:
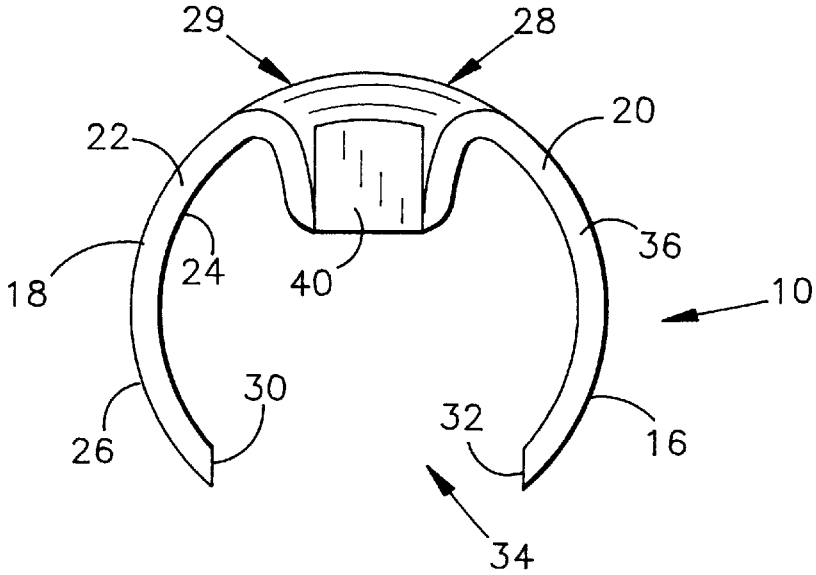
FIG. 6 is an end view of the orifice protector shown in the preceding figures.

As shown in FIGS. 1 through 6, each orifice protector 10 generally comprises a body 16 in the form of a partial cylinder or collar 18 defined by a wall 20 having a C-shaped cross section, particularly as shown by the end view, FIG. 6. The wall 20 has an outer surface 22 and an inner surface 24. A central portion 26 of the wall 20 includes a plurality of openings 28 extending between the outer and inner surfaces 22 and 24. The wall 20 also has two longitudinal edges 30 and 32 separated by a slot 34 adapted to receive conduit 12. The material of which the orifice protector body 16 is made permits the two longitudinal edges 30 and 32 to deflect away from each other and be biased toward each other to grip the conduit 12. The wall 20 also has two ends 36 and 38 and includes stand-off portions 40 and 42, respectively, for maintaining the central portion 26 of the wall 20 spaced from said conduit 12.

Each of the plurality of openings 28 in the central portion 26 of the wall 20 preferably has a sufficiently small cross-section to inhibit the migration of the adjacent material toward the adjacent orifice 14 being protected by the protector 10. The plurality of openings 28 in the central portion 26 of the wall 20 taken together preferably have a cross-sectional area many times that of the adjacent orifice 14 thereby providing ample area for outflow of wastewater. Preferably the plurality of openings 28 are situated with respect to the adjacent orifice 14 as to diffuse the outward flow of wastewater.

The plurality of openings 28 in an orifice protector 10 can take any number of shapes, however a plurality of slits 29 situated generally parallel to the ends 36 and 38 of the protector 10, as shown in FIGS. 1 and 3 through 5, has proven to be a particularly advantageous arrangement. Preferably each of the slits 29 extends through about a 90° arc length of the wall 20 forming the orifice protector 10. The stand-off portions 40 and 42 preferably are integral with the wall portion 20 of the orifice protector 10, and are preferably formed by downwardly and inwardly indented portions of the two ends 36 and 38 of the wall 20 forming the orifice protector 10.

The slot 34 allows the orifice protector 10 to be added at any point along a nearly continuous length of conduit 12, rather than having to be threaded or slipped onto an end of a section of a conduit 12. The size of the slot 34 and the length of the stand-off portions 40 and 42 are chosen to provide sufficient gripping force between the orifice protector 10 and the conduit 12, over a selected range of diameters of the conduit 12, to maintain the orifice protector 10 at a fixed location, even during system installation procedures such as back fill operations, and the like. The stand off portions 40 and 42 ensure that the openings 28 in the central portion 26 of the orifice protector wall 20 are spaced from the adjacent orifice 14 thus providing a region 44 into which wastewater from the conduit 12 can flow without immediately facing the material such as soil, rocks, stones, pebbles or gravel in which the system 11 is buried. The stand off portions 40 and 42 also function to inhibit the material such as soil, rocks, stones, pebbles or gravel in which the system 11 is buried from migrating into the space between the conduit 12 and the orifice protector 10.

The orifice protector body 16 can be of any suitable thickness but is most easily formed to have a substantially constant thickness separating the outer and inner surfaces 22 and 24. A readily available material for forming the orifice protector 10 is generally known as schedule 40 plastic tubing, typically pvc or abs, that is conventionally employed in wastewater systems. The schedule 40 plastic tubing can be cut into suitable lengths and cut again to form the two longitudinal edges 30 and 32 that are preferably linear and substantially parallel to each other. The ends 36 and 38 are then plastically deformed to the desired shape to form the stand-off portions 40 and 42. Of course, the same or a functionally equivalent shape can be obtained by injection molding or other suitable processes.

While the invention has been described with reference to the preferred embodiment shown in the accompanying figures, other variations and modifications may become apparent to those skilled in the art, which would still come within the scope and spirit of the invention as defined in the following claims.

What is claimed is:

1. An orifice protector for use in subterranean fluid dispensing systems defined by at least one conduit for disposing of wastewater, the orifice protector comprising:

a body in the form of partial cylinder defined by a wall having a C-shaped cross section, the wall having an outer and an inner surface, a central portion of the wall including a plurality of openings extending between the outer and inner surfaces, the wall also having two longitudinal edges separated by a slot adapted to receive said conduit, the two longitudinal edges being deflectable away from each other and biased toward each other to grip said conduit, the wall also having two ends including stand-off portions for maintaining the central portion of the wall spaced from said conduit.

2. The orifice protector of claim 1 wherein the plurality of openings comprise a plurality of slits situated about parallel to said ends.

3. The orifice protector of claim 1 wherein the stand-off portions comprise downwardly and inwardly indented portions of the two ends of said wall.

4. The orifice protector of claim 1 wherein the wall has a substantially constant thickness separating the outer and inner surfaces.

5. The orifice protector of claim 1 wherein the two longitudinal edges are linear and substantially parallel to each other.

6. An orifice protector for use in subterranean fluid dispensing systems defined by at least one conduit for disposing of wastewater, the orifice protector comprising:

a body in the form of partial cylinder having two ends, the partial cylinder being defined by a wall having a C-shaped cross section, the wall having an outer and an inner surface, a central portion of the wall including a plurality of openings extending between the outer and inner surfaces, the wall also having two longitudinal edges separated by a slot adapted to receive said conduit, the two longitudinal edges being deflectable away from each other and biased toward each other to grip said conduit, the body including stand-off portions for maintaining the central portion of the wall spaced from said conduit.

7. The orifice protector of claim 6 wherein the plurality of openings comprise a plurality of slits situated about parallel to said ends and extending through about a 90° arc length.

8. The orifice protector of claim 6 wherein the stand-off portions are integral with the two ends of said wall and comprise downwardly and inwardly indented portions of the two ends of said wall.

9. The orifice protector of claim 6 wherein the wall is of substantially constant thickness.

10. The orifice protector of claim 6 wherein the two longitudinal edges are linear, of equal length, and substantially parallel to each other.

11. An orifice protector for use in subterranean fluid dispensing systems defined by at least one conduit for disposing of wastewater, the orifice protector comprising:

a body in the form of partial cylinder having two ends, the partial cylinder being defined by a wall of substantially constant thickness having a C-shaped cross section, the wall having an outer and an inner surface, a central portion of the wall including a plurality of openings extending between the outer and inner surfaces, the wall also having two longitudinal, linear, parallel edges of equal length separated by a slot adapted to receive said conduit, the two longitudinal edges being deflectable away from each other and biased toward each other to grip said conduit, the body including stand-off portions for maintaining the central portion of the wall spaced from said conduit.

12. The orifice protector of claim 11 wherein the stand-off portions are integral with the two ends of said wall and comprise downwardly and inwardly indented portions of the two ends of said wall.

13. The orifice protector of claim 12 wherein the plurality of openings comprise a plurality of slits situated about parallel to said ends and extending through about a 90° arc length.

14. An orifice protector for use in subterranean fluid dispensing systems defined by at least one conduit having a diameter within a selected range for disposing of wastewater, the orifice protector comprising:

a body in the form of partial cylinder having a diameter greater than said selected range and having two ends, the partial cylinder being defined by a wall of substantially constant thickness having a C-shaped cross section, the wall having an outer and an inner surface, a central portion of the wall including a plurality of slits extending between the outer and inner surfaces, the slits being situated about parallel to said ends and extending through about a 90° arc length, the wall also having two longitudinal, linear, parallel edges of equal length separated by a slot adapted to receive said conduit, the two longitudinal edges being deflectable away from each other and biased toward each other to grip said conduit, the body including stand-off portions integral with the two ends of said wall and consisting essentially of downwardly and inwardly indented portions of the two ends of said wall for maintaining the central portion of the wall spaced from said conduit.

* * * * *